United States Patent [19]

Petron

[11] 4,390,100

[45] Jun. 28, 1983

[54] MAIL SORTER WITH AN EXPANDABLE BELLOWS BINDING

[76] Inventor: Darlene M. Petron, 16612 Park La., Wayzata, Minn. 55391

[21] Appl. No.: 230,403

[22] Filed: Jan. 30, 1981

[51] Int. Cl.[3] ..... B42F 21/00

[52] U.S. Cl. ..... 211/10; 211/11

[58] Field of Search ..... 211/10, 11, 50; 312/50, 312/193

[56] References Cited

U.S. PATENT DOCUMENTS

| | | | |
|---|---|---|---|
| 730,562 | 6/1903 | Parks | 211/11 |
| 764,299 | 7/1904 | Marsh | 211/10 |
| 1,031,595 | 7/1912 | Taber | 312/50 X |
| 1,216,250 | 2/1917 | Bittle | 211/10 X |
| 1,682,667 | 8/1928 | Eifel | 211/50 |
| 2,249,265 | 7/1941 | Bauder | 211/11 |
| 2,765,925 | 10/1956 | Raach, Sr. | 211/11 |
| 2,876,907 | 3/1959 | Amberg | 211/11 |
| 3,000,509 | 9/1961 | Larter | 211/11 |
| 3,948,395 | 4/1976 | Thornton | 211/11 |

*Primary Examiner*—Francis K. Zugel

*Assistant Examiner*—Peter A. Aschenbrenner

*Attorney, Agent, or Firm*—LeBlanc, Nolan, Shur & Nies

[57] ABSTRACT

A mail sorter made up of a plurality of identical leaves each coded to one or more addresses with a flexible and expandable bellows binding joining the leaves into a book whereby the leaves may be arranged on a flat surface in staggered, stair step, offset fashion for sorting of mail by insertion of individual mail pieces between the leaves, whereupon the leaves may be gathered into superposed relationship and turned to a vertical orientation with the mail between the leaves, whereupon the resultant neat stack of sorted, superposed mail pieces may be easily removed from the mail sorter book. Identical, aligned apertures may be formed through the leaves to facilitate removal of sorted mail from the book, as by insertion of a pencil or the like through the apertures and movement of the pencil, against the sorted mail, towards the open end of the mail sorter book. Each leaf of the book may be multiply coded in sets of indicia, so that a single sorter may be used to repetitively sort mail by address, for a number of streets, buildings, etc. Both faces of each leaf may be coded.

4 Claims, 5 Drawing Figures

MAIL SORTER WITH AN EXPANDABLE BELLOWS BINDING

BACKGROUND OF THE INVENTION

The invention relates generally to sorters or presorters for sheet material, such as mail, papers or documents and the like wherein the sorter includes a plurality of coded or tabbed leaves interconnected at one end and open at the other end for insertion of the documents during sorting. More particularly, the invention is directed to an improved sorter for mail or the like composed of a plurality of identical leaves, each coded to a specific address or addresses, and interconnected by a flexible, bellows binding so the space between any pair of adjacent leaves may be varied to accommodate the pieces inserted therebetween and further to permit the leaves to be laid upon a horizontal surface or table in a staggered offset relationship so the coded information on each individual leaf may be readily perceived during the mail sorting process and, at the completion of sorting, the sorter book and sorted mail may all be gathered up into a neat, superposed relationship to greatly facilitate removal of the sorted mail or documents from the sorter book.

Generally speaking, the assembly of mail or other documents by a device including a plurality of coded leaves connected together at one end and open at the other for insertion of mail, papers or other documents is well known. For example, U.S. Pat. No. 764,299 issued July 5, 1904 to J. J. Marsh shows a table for post office use including a number of coded, bent wire dividers having pronged ends for hinged insertion of the dividers into opposed, paired apertures on the table. If the space between dividers is too small to accommodate the mail being sorted, a divider may be removed and reinserted in another set of apertures to increase the spacing between dividers. This sorter is a large piece of furniture rather than a small, easily handled device, is designed to replace the usual pigeonhole case rather than supplement it, and there is no disclosure of multiple set coding of the sorter as set forth in detail hereinbelow.

A portable assorting case for use by a letter carrier is disclosed in U.S. Pat. No. 660,541, issued Oct. 23, 1900 to M. S. Field. The case has flexible, bellows type hinges along two adjacent sides, the other two sides being open for insertion of letters. The front of each divider is open so the letter carrier may read the address on the letter without removing it as he goes about his mail delivering duties. However, the case is not coded at all and is designed to be carried by the postman during delivery of mail rather than being used as a presorter of mail. Furthermore, since this expandable case is bound on two sides, it cannot be laid open in stair step fashion for use as a presorter and each space between adjacent leaves of the book is limited by the two side binding construction.

U.S. Pat. No. 1,797,355 issued Mar. 24, 1931 to H. H. Martin illustrates a presorter having leaves bound at one edge to thus form a presorter book, but the binding is rather inflexible, thus placing limitations on the amount of material that may be inserted between adjacent leaves, and multiple set coding of the type herein disclosed and claimed is not present. The Martin structure is also shown in U.S. Pat. No. 3,948,395 issued Apr. 6, 1976 to K. E. Thornton, this patent being directed to an edge tab structure.

Multipurpose coding by sets for the leaves of a presorter is disclosed to an extent in U.S. Pat. No. 2,876,907 issued Mar. 10, 1959 to G. W. Amberg but the coding sets are essentially unrelated to one another. This presorter further includes leaves of varying sizes so that the leaves are always in stair step, offset relationship and the binding thereof is relatively inflexible. More remote disclosures of presorters having stair-step leaves appear in U.S. Pat. Nos. 3,008,582 issued Nov. 14, 1961 to E. M. Kent and 3,876,077 issued Apr. 8, 1975 to C. E. Jones.

The prior art does not disclose a presorter having a plurality of leaves connected by a flexible bellows hinge along one edge of each leaf to form a presorter book which may be expanded open into a stair-step, offset arrangement of leaves, each leaf being multiple set coded on both faces so that the same sorter may be used for a series of progressive sorting steps in an overall sorting operation, such as arrangement of mail for delivery by a letter carrier.

SUMMARY OF THE INVENTION

Accordingly, it is a principal object of the invention to provide a document sorter mode of a plurality of superposed leaves and a flexible bellows binding along one side of the leaves so the sorter may be spread open to array the leaves in staggered, stair step fashion and, after sorting, the leaves and documents may be gathered into a book form to facilitate removal of the documents.

It is another object of the invention to provide a document sorter including a plurality of identically sized leaves with a flexible bellows binding, each leaf bearing plural, multiple sets of coded indicia, some sets being identical and some being different.

It is a further object of the invention to provide a document sorter made of a plurality of leaves with a flexible bellows binding that is reversible so that sorting indicia may be placed on both faces of each leaf in the sorter.

It is yet another object of the invention to provide a document sorter made up of a plurality of leaves connected together by a flexible bellows binding, each leaf having an aperture formed therethrough, so that the sorter may be spread open with the leaves arranged in staggered, stair-step fashion for a sorting operation and, after sorting, the leaves and inserted documents may be gathered together and a pencil or the like may be inserted behind the documents and moved to push the documents neatly out of the sorter.

As disclosed and claimed hereinbelow, the document sorter of the present invention includes any desired number of identically sized leaves made of relatively stiff board material (e.g., cardboard, plastic, etc.) each having an identically sized aperture formed centrally therethrough, the leaves being bound along a selected identical edge of each leaf by a relatively flexible, bellows binding to thus form a sorter book which may be spread open so the leaves are arrayed in a staggered, stair step arrangement for a sorting operation. The book is reversible so that each face of each leaf may bear coded indicia to facilitate sorting. After sorting, the leaves with inserted documents may be gathered together so that each leaf is superposed over another, and then a pencil or the like may be inserted through the apertures of the leaves, behind the documents and the documents may be neatly pushed out of the sorter.

The leaves of the sorter may be multiple set coded, as by colors and numbers, for example. In a preferred embodiment, the invention is employed as a mail sorter in conjunction with a sorting case where mail is very roughly presorted into, say, a number of bins, each bin representing a whole street of house numbers or a portion of the street. The sorter of this invention is then used to sort the mail into a final arrangement, ready for delivery to each addressee, in a predetermined order. For example, the sorting case could have eight bins, each color coded for a particular street or portion of a street. The sorter of this invention could then have eight colored tabs along a free edge of each leaf, coordinated with the case bin colors, the tabs on each leaf being identical. Each leaf would be printed with an addressee number for each individual addressee, so the numbers in any selected color portion of adjacent leaves would, of course, be different. The sorter is reversible so that the reverse faces of each leaf could be similarly coded with another presortment case bin. Or, a selected case bin could be coordinated half with one side of the sorter and half with the other side of the sorter. In any event, a single sorter of this invention can be thus used to sort a great deal of mail (or other documents) into final form, ready for delivery.

DESCRIPTION OF THE DRAWINGS

These and further objects and advantages of the present invention will become readily apparent by reference to the following detailed specification and drawings in which.

DESCRIPTION OF THE PREFERRED EMBODIMENTS

Figure 1:
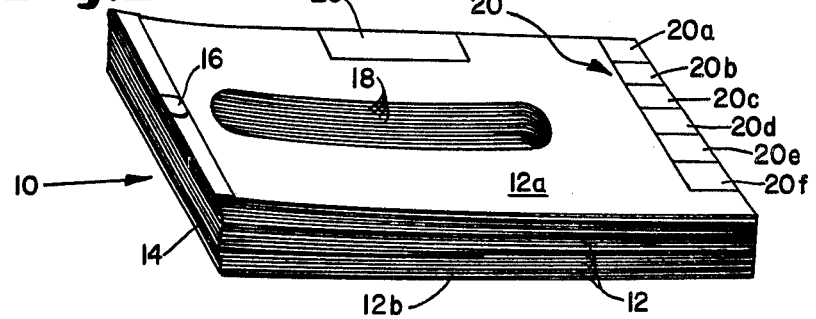
FIG. 1 is a perspective view of the sorter with its leaves arranged one above the other and ready for use.

Referring now to the drawings by reference character, a sorter 10 is illustrated, composed of a predetermined plurality of identical, individual leaves 12 bound together along one edge of each leaf by a flexible bellows binding 14. Thus, prior to or after use, the sorter may be arranged in the compact, book form illustrated by FIG. 1. When a sorting operation is to be undertaken, the first leaf, 12*a*, may be grasped at the left edge, in the tabbed area marked at 16 and the last or bottom leaf 12*b* may be grasped at its right hand end. The two leaves 12*a* and 12*b* are then pulled apart to array the leaves into the staggered, stair step arrangement illustrated in FIG. 2.

Each leaf 12 may be made of relatively stiff, board like material such as cardboard, plastic or the like and the binding 14 is made of a relatively flexible and foldable material, bonded, sealed or glued to the left, short edge of each leaf 12. Manufacturing costs are minimized since each leaf 12 is identical in size and shape. In a relatively inexpensive embodiment of the invention, each leaf 12 is made of cardboard or paperboard and flexible binding 14 may be a variety of relatively sturdy yet flexible adhesive tape.

Figure 2:
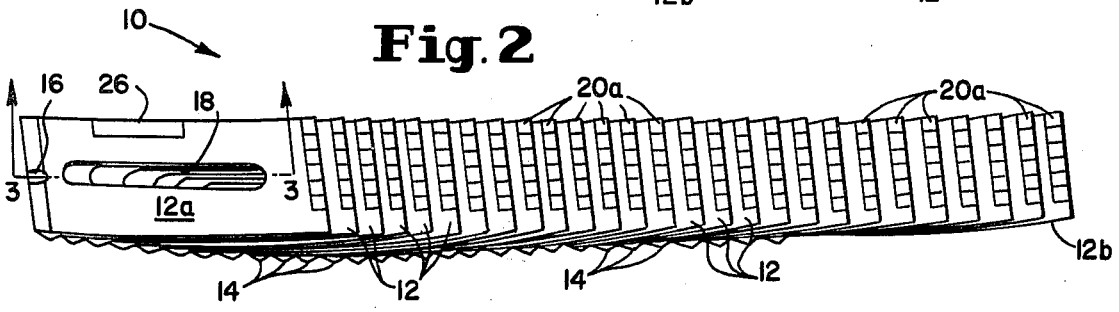
FIG. 2 is a perspective view of the sorter with the leaves spread out into a staggered, stair step arrangement so that mail (or other documents) may be sorted.
Figure 3:
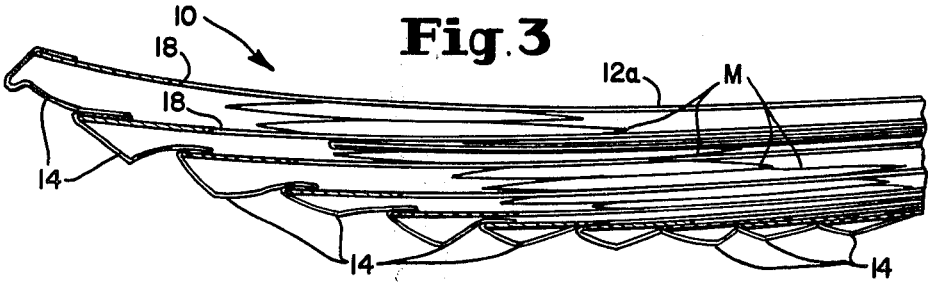
FIG. 3 is a partial section view, taken along lines 3—3 of FIG. 2.
Figure 4:
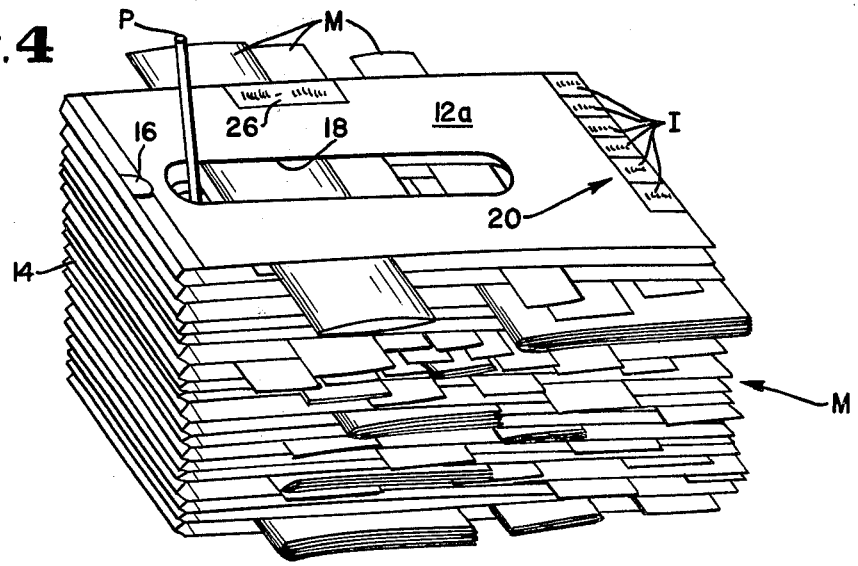
FIG. 4 is a perspective view of the sorter, documents having been inserted between the sorter leaves and arranged for removal of the documents from the sorter.

Additionally, each leaf 12 is identically apertured at 18 for facilitating removal of the mail or sorted documents M after sorting is completed. As shown in FIG. 4, the leaves are gathered together with the documents M into the disposition also shown in FIG. 1, prior to insertion of the documents or mail M. (If the documents are somewhat bulky, the leaves 12 may be regathered about 75% of the way; use of sorter 10 becomes easier through practice by an individual). Then, as shown in FIG. 4, a rod like instrument such as a pencil or pen P is inserted through the apertures 18, to the left of the mail M, and pushed to the right in the sense of FIG. 4 to remove the mail in the sorter 10, as a neat stack of mail, completely arranged and sorted for delivery. Thereafter, the sorter 10 may be condensed for storage, as shown in FIG. 1, or be spread open again for a further sorting operation, as illustrated in FIG. 2.

Another feature of the invention is the multiple set coding system briefly outlined above. In the embodiment shown, each leaf 12 may be provided with a series of labels or tabs 20, all of which become visible when the sorter 10 is opened for a sorting operation, as shown in FIG. 2. As shown in FIG. 1, on each leaf, each tab may be differently colored. For example, label 20*a* could be white; label 20*b*, green; label 20*c*, red; label 20*d*, orange; label 20*e*, blue; and label 20*f*, yellow. (Of course, any number of labels with any variety of colors may be utilized). Each label 20*a* on each leaf 12 will be similarly positioned and similarly color coded. In sorting mail, for example, each color could represent a different street or portion of a street. Thus, white (labels 20*a*) could represent "A" street, green (labels 20*b*) could represent "B" street, and so on. Additionally, each label of each color coded set can be marked with indicia I (see FIG. 4) to denominate a particular address (e.g., a house number). Thus, for "A" street, the top leaf label 20*a* could be marked "2000", the label 20*a* on the next leaf could be marked "2002", and so on.

Thus, when the mail for "A" street is to be sorted, the address on each mail piece M is determined and then that piece is inserted into its proper place between adjacent leaves 12. When the "A" street mail is sorted, it may be removed as explained above.

Then, sorter 10 may be spread open again (FIG. 2) and the "B" street mail may be sorted, each label 20*b* on each leaf having been previously coded for its designated addressee. After the "B" street mail is sorted, the "C" street mail may be sorted, and so on until all of the mail is sorted for delivery.

If desired, sorter 10 may be used with a presorter case (not shown) having individual bins for preliminary storage of mail prior to sorting. Thus, one bin may have a white label for "A" street mail, another have a green label for "B" street mail, and so forth. Of course, each bin label may have the street name imprinted upon it as well.

Thus, it can be seen that with but a single sorter 10, a number of sorting operations may be carried out in serial fashion without having to employ another sorter. Additionally, the present invention provides further flexibility in that some streets may have fewer addresses than others; for example, if "B" street has fewer addresses than "A" street, not all the spaces between leaves 12 need be used when sorting "B" street mail, while all could be used in sorting "A" street mail.

Figure 5:
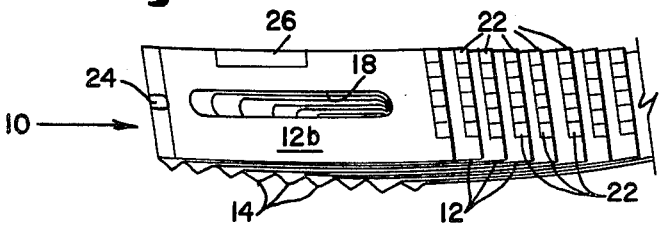
FIG. 5 is a perspective view of the sorter as shown in FIG. 2 but reversed or turned over for use with coded indicia appearing on the reverse faces of each leaf of the sorter.

If there is not enough room on the top face of leaves 12 to indicate all of the streets for mail sorting, sorter 12 may be reversed as shown in FIG. 5 and the underside of each leaf 12 can be marked with additional labels or tabs 22, coded to the additional streets. Thus, the leaf 12*b*, formerly at the bottom of sorter 10, becomes the top leaf and includes a holding tab 24 which functions the same as tab 16 explained above. Thus, unlike prior art sorters, the sorter 10 of this invention has identical leaves 12 throughout its entire construction, with no need for a separate and distinct base structure which would prevent reversal of the sorter and utilization of the reverse sides of each leaf 12 for sorting operations.

Of course, if it is desired to use sorter 10 for only one street and provide a separate sorter for each additional street, any one sorter 10 may be provided with a label 26 upon which is printed the street name. Then each leaf need bear only a single label 20*a*, each being marked with a predetermined address.

Obviously, the sorter of this invention may be utilized for a wide variety of filing or sorting operations, in offices, warehouses, etc., for sorting of any variety of documents, such as letters, bills, receipts and so forth.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by Letters Patent is:

1. A device for sorting sheet material such as mail, correspondence, documents or the like comprising: a plurality of superposed leaves having identical length and width dimensions, said leaves defining sorting or classifying spaces between adjacent ones of said leaves; and a flexible, bellows binding secured to a selected edge of each of said leaves, said bellows binding providing the only means of permanent attachment between adjacent leaves, said selected edge being identical for all of said leaves to thus form a flexible bellows bound sorting book of superposed leaves, which may be spread open, as by grasping the uppermost and lowermost leaves of said book, so that said leaves are disposed in staggered, stair-step, offset fashion to ease insertion of the material being sorted between adjacent leaves and, upon completion of a sorting operation, said leaves may be gathered together into superposed relationship to facilitate simultaneous or serial removal of the sorted documents from between the leaves of said book, said device being reversible so that either the upper or lower faces of all of said leaves will be visible when said book is spread open with said leaves disposed in stair-step, offset fashion, each of said leaves having at least one set of identifying indicia on each face of each of said leaves, said indicia on either the upper or lower faces of all of said leaves being visually perceivable when said book is spread open.

2. The sorting device as claimed in claim 1 wherein each of said leaves is made of relatively stiff, board like material and said binding is made of material relatively far more flexible than said board like material.

3. The device of claim 1 wherein a plurality of sets of indicia are provided on each face of each of said leaves, and wherein at least one set of indicia differs from one other set.

4. A device for sorting sheet material such as mail, correspondence, documents or the like comprising: a plurality of superposed leaves which define sorting or classifying spaces between adjacent ones of said leaves; and a flexible, bellows binding secured to a selected edge of each of said leaves, said selected edge being identical for all of said leaves to thus form a flexible bellows bound sorting book of superposed leaves, which may be spread open, as by grasping the uppermost and lowermost leaves of said book, so that said leaves are disposed in staggered, stair-step, offset fashion to ease insertion of the material being sorted between adjacent leaves and, upon completion of a sorting operation, said leaves may be gathered together into superposed relationship to facilitate simultaneous or serial removal of the sorted documents from between the leaves of said book, said device including means defining an elongate aperture through each leaf whereby, when said leaves are gathered together in superposed relationship after a sorting operation, removal of the sorted material may be facilitated as by insertion of a rod like tool through the apertures, between said flexible binding and the sorted material, and moved away from said binding to slide the sorted material out of said book.

* * * * *